United States Patent [19]

Asano et al.

[11] Patent Number: 4,506,521

[45] Date of Patent: Mar. 26, 1985

[54] COOLING AND HEATING DEVICE

[75] Inventors: Tadashi Asano; Tadashi Suzuki; Tadatsugu Fujii, all of Gifu, Japan

[73] Assignee: Mitsubishi Denki Kabushiki Kaisha, Tokyo, Japan

[21] Appl. No.: 448,659

[22] Filed: Dec. 10, 1982

[30] Foreign Application Priority Data

Dec. 22, 1981 [JP] Japan ..... 56-207510
Dec. 22, 1981 [JP] Japan ..... 56-207511
Dec. 24, 1981 [JP] Japan ..... 56-215687

[51] Int. Cl.[3] ..... F25B 41/00; F25B 27/02

[52] U.S. Cl. ..... 62/238.7; 62/324.1; 237/2 B

[58] Field of Search ..... 62/81, 238.7, 238.6, 62/155, 324.6, 324.1; 237/2 B; 165/62

[56] References Cited

U.S. PATENT DOCUMENTS 3,190,079 6/1965 Lauer ..... 62/155
4,055,963 11/1977 Shoji et al. ..... 62/238.6

*Primary Examiner*—William E. Wayner

*Assistant Examiner*—John Sollecito

*Attorney, Agent, or Firm*—Sughrue, Mion, Zinn, Macpeak, and Seas

[57] ABSTRACT

A cooling and heating device having a cooling cycle circuit and a heating cycle circuit with a refrigerant heater for heating refrigerant includes a cooling circuit extending from a compressor through an outdoor heat exchanger, a resistance element (capillary) and an indoor heat exchanger to the suction inlet side of the compressor; and a heating circuit extending from between the discharge outlet side of the compressor and the outdoor heat exchanger directly through the indoor heat exchanger and the refrigerant heater to the suction inlet side of the compressor. In the heating operation, the high temperature refrigerant from the compressor, which is heated by the refrigerant heater, flows in the indoor heat exchanger in a direction opposite to that in which the refrigerant flows in the cooling operation, so that the refrigerant radiates heat through the indoor heat exchanger, and the refrigerant phases on either side of the indoor heat exchanger are the same for either cooling or heating.

23 Claims, 6 Drawing Figures

COOLING AND HEATING DEVICE

BACKGROUND OF THE INVENTION

This invention relates to a cooling and heating device which is provided by adding a heating cycle circuit including a refrigerant heater to a cooling cycle circuit.

In most conventional cooling and heating devices, a refrigerant heater, which is a heat supply source in the heating operation, is incorporated in a cooling cycle circuit including a compressor, an outdoor heat exchanger (or a cooling condenser), a capillary tube and an indoor heat exchanger (or a cooling evaporator). In general, the refrigerant heater is provided between the indoor heat exchanger and the compressor, and in the cooling operation, low temperature refrigerant gas flows in the refrigerant heater. The flow of refrigerant through the refrigerant heater is permitted during the cooling operation, because the refrigerant heater is not in operation during the cooling operation and not obstructive with respect to the cooling operation.

However, the conduction of refrigerant to a refrigerant heater which is not in operation frequently results in the occurrence of problems in the refrigerant heater. In other words, dew is formed on the refrigerant heater by the conduction of the refrigerant, which causes corrosion.

In switching the cooling operation over to heating, it is difficult, because of the resistance of the capillary tube, to purge the refrigerant into the heating cycle circuit through the capillary tube. Therefore, it is necessary to provide a purging bypass circuit including an operating element such as an electromagnetic valve. Thus, the cooling and heating device of this type becomes rather intricate in construction.

SUMMARY OF THE INVENTION

Accordingly, an object of this invention is to provide a cooling and heating device of simple arrangement and high reliability in which corrosion due to dew condensation in the refrigerant heater is prevented.

Another object of the invention is to provide a cooling and heating device in which dew condensation in the refrigerant heater is prevented, in which the refrigerant can be readily led out of the cooling cycle circuit when cooling is switched over to heating, and wherein the refrigerant thus led out can be delivered directly to the refrigerant heater, and which is simple in construction and can readily secure the amount of refrigerant sufficient for circulation.

A cooling and heating circuit according to the invention has a cooling circuit including a compressor, an outdoor heat exchanger, a capillary tube and an indoor heat exchanger, in which the connecting point between the indoor heat exchanger and the compressor is connected through a refrigerant heating circuit including a refrigerant heater in parallel with the indoor heat exchanger to the connecting point between the capillary and the indoor heat exchanger. A heating circuit for supplying, in the heating operation, refrigerant from the compressor to the indoor heat exchanger in a direction opposite to that in which refrigernat is supplied in the cooling operation extends from the refrigerant circuit downstream of the compressor, so that a heating cycle circuit including the compressor, the heating circuit, and the indoor heat exchanger is formed.

Furthermore, one end of the capillary tube in the refrigerant circuit is connected through a purge circuit to the heating circuit on the inlet side of the refrigerant heater, so that the refrigerant pooled in the outdoor heat exchanger is delivered through the purge circuit directly to the refrigerant heater.

The foregoing objects as well as other objects and the characteristic features of the invention will become more apparent from the following detailed description when read in conjunction with the accompanying drawings.

BRIEF DESCRIPTION OF THE DRAWINGS

In the accompanying drawings:

FIG. 5 is a refrigerant system diagram showing the fifth embodiment, and FIG. 6 is a graphical representation for describing the operation of the fifth embodiment.

DETAILED DESCRIPTION OF THE PREFERRED EMBODIMENTS

Figure 1:
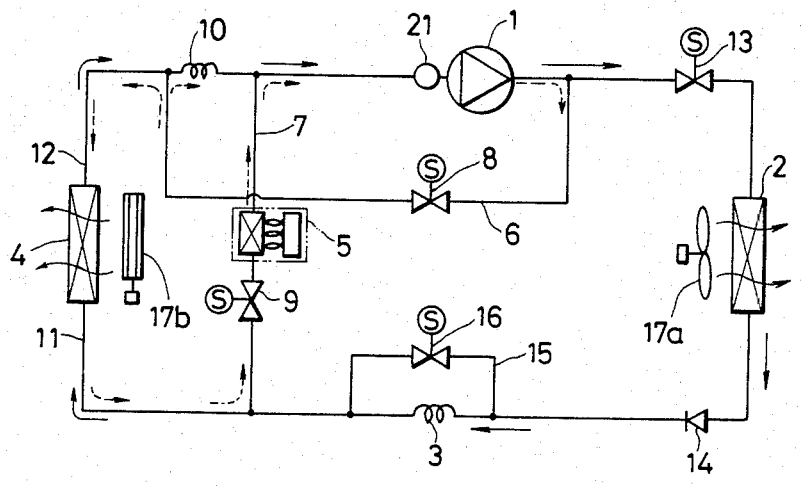
FIG. 1 is a refrigerant system diagram showing a first embodiment of this invention.

A cooling and heating device according to a first embodiment of this invention, as shown in FIG. 1, comprises: a cooling cycle (or refrigerant) circuit including a compressor 1, an outdoor heat exchanger (or a cooling condensor) 2; a capillary tube 3 and an indoor heat exchanger (or a cooling evaporator) 4; and a heating cycle circuit including a refrigerant heater 5, the compressor 1 and the indoor heat exchanger 4. The heating cycle circuit is included within the cooling cycle circuit; however, the outdoor heat exchanger 2 and the cooling capillary tube 3 form a cycle circuit separated from the heating cycle circuit. In other words, a heating refrigerant circuit 6 shunting the compressor 1 and a refrigerant heating circuit 7 bridging the input and output sides of the indoor heat exchanger 4 are provided in the cooling refrigerant circuit, so that no refrigerant flows in the outdoor heat exchanger 2 or the capillary tube 3 during the heating operation. The heating refrigerant circuit 6 has an electromagnetic valve 8 which closes the circuit 6 during the cooling operation. The refrigerant heating circuit 7 includes a valve element 9, such as a check valve or an electromagnetic valve, and the refrigerant heater 5, which is connected in series with the valve element 9. One connection point between the heating refrigerant circuit 6 and the cooling refrigerant circuit on the side of the indoor heat exchanger 4 is closer to the indoor heat exchanger 4 than the connection point between the refrigerant heating circuit 7 and the refrigerant circuit. The refrigerant circuit between the two connection points mentioned above includes a resistance element (such as a capillary or a throttle valve) 10.

In FIG. 1, reference numeral 13 designates an electromagnetic valve for controlling the conduction of refrigerant to the outdoor heat exchanger; 14 is a check valve; and 15 is a purge circuit having a purging electromagnetic valve 16 connected in parallel with the capillary tube 3.

Further in FIG. 1, reference numerals 11 and 12 designate connecting pipes connected to both ends of the indoor heat exchanger 4, respectively; 17*a* and 17*b* are blowers; and 21 is an accumulator provided near the suction inlet of the compressor 1.

The operation of the cooling and heating device thus constructed will now be described. For the cooling operation, the refrigerant is circulated in the loop including the compressor 1, the outdoor heat exchangar 2, the capillary tube 3 and the indoor heat exchanger 4, as indicated by the solid line, by opening electromagnetic value 13 and closing electromagnetic valve 8. For the heating operation, refrigerant is circulated in the loop including the compressor 1, the heating refrigerant circuit 6, the indoor heat exchanger 4 and the refrigerant heater 5 by closing the electromagnetic valve 13 and opening the electromagnetic valve 8. In the heating operation, a part of the refrigerant flowing in the heating refrigerant circuit 6 is returned through the resistance element 10 to the compressor 1. In this case, the path through which the refrigerant runs while carrying heat for the purpose of heating is short, and the refrigerant does not pass through cooling members such as the outdoor heat exchanger 2 and the capillary tube 3, which radiate heat. Therefore, heat from the refrigerant heater 5 is effectively sent to the indoor heat exchanger 4. Furthermore, during the cooling operation valve 9 is closed and thus no refrigerant is delivered to the refrigerant heater 5, and therefore the heater 5 is not subjected to corrosion due to dew condensation. The cooling and heating device of the invention is designed so that the direction of refrigerant conduction to the indoor heat exchanger 4 during the cooling operation is opposite that during the heating operation, and therefore in both the cooling and heating operations, the respective phase of the refrigerant in the connecting pipes 11 and 12 of the indoor heat exchanger 4 can be the same. Accordingly, a pipe for liquid phase refrigerant and one for gaseous phase refrigerant can be employed as connecting pipes 11 and 12 of the indoor heat exchanger 4, respectively. In other words, during the cooling operation, refrigerant in the liquid phase flows in the connecting pipe 11 of the indoor heat exchanger 4 and gaseous refrigerant flows in the connecting pipe 12; and during the heating operation, refrigerants in the same phase flow in the connecting pipes 11 and 12, but in directions opposite that in the cooling operation. Accordingly, the connecting pipe 11 in which only liquid refrigerant flows may be made of a thin pipe which can be readily processed and arranged as compared with a pipe in which refrigerant gas flows.

When the cooling operation is switched over to heating, it is necessary to lead the refrigerant circulating in the cooling cycle circuit into the heating cycle circuit. For this purpose, the purging electromagnetic valve 16 is connected in parallel with the capillary tube 3. Opening the electromagnetic valve 16 can deliver that refrigerant which, in spite of the closure of the electromagnetic valve 13, has been pooled in the outdoor heat exchanger 2 by the slow leakage of the valve 13, to the heating cycle circuit, whereby the circulation of refrigerant can be ensured in the heating operation.

Figure 2:
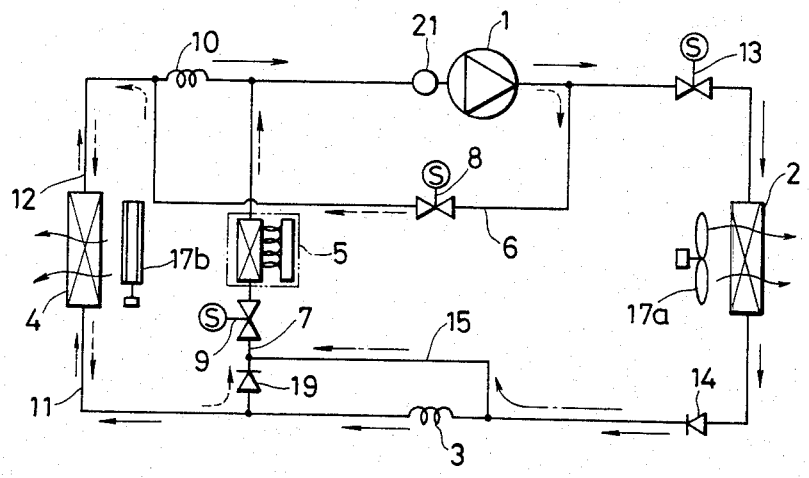
FIG. 2 is a refrigerant system diagram showing a second embodiment of the invention.

A second embodiment of the invention is as shown in FIG. 2. In FIG. 2, reference numeral 15 designates a purge circuit which is connected in parallel with a capillary tube 3; and 7, a refrigerant heating circuit including a series circuit of an electromagnetic valve 9, a check (one way) valve 19 and a refrigerant heater 5. The connecting point of the valves 9 and 19 is connected to the purge circuit 15. The remaining circuit elements, being similar to those in FIG. 1, are designated by the same reference characters and thus a detailed description thereof will be omitted.

This cooling and heating device, similarly to the first embodiment shown in FIG. 1, operates in cooling such that refrigerant is circulated in the loop including the compressor 1, the outdoor heat exchanger 2, the capillary tube 3 and the indoor heat exchanger 4. In the heating operation, the refrigerant is circulated in the loop including the compressor 1, the heating refrigerant circuit 6, the indoor heat exchanger 4, the check valve 19, the electromagnetic valve 9 and the refrigerant heater 5. In the heating operation, a part of the refrigerant flowing in the heating refrigerant circuit 6 is returned through the resistance element 10 to the compressor 1.

When cooling is switched over to heating, it is necessary to lead the refrigerant circulated in the cooling cycle circuit into the heating cycle circuit. In other words, since the refrigerant becomes pooled in the outdoor heat exchanger 2 because of the slow leakage of the electromagnetic valve 13 provided on the inlet side of the outdoor heat exchanger 2 even when the valve 13 is closed, in order to secure an adequate amount of refrigerant to be circulated in the heating operation, it is necessary to lead the refrigerant out of the outdoor heat exchanger 2. In the second embodiment of FIG. 2, the refrigerant in the outdoor heat exchanger 2 can be led directly to the inlet side of the refrigerant heater 5 by the purge circuit 15 which is connected between one end of the capillary tube 3 in the refrigerant circuit and the connecting point of the check valve 19 and the electromagnetic valve 9 in the refrigerant heating circuit 7. It is thus unnecessary to provide operating elements in the purge circuit 15; that is, the latter may merely be a connecting circuit. Thus, referigerant can be sufficiently supplied to the refrigerant heater 5, so as to prevent overheating of the latter. Furthermore, the heating stoppage period of the refrigerant heater 5 can be made short, and the room temperature can be quickly increased in the heating operation.

Figure 3:
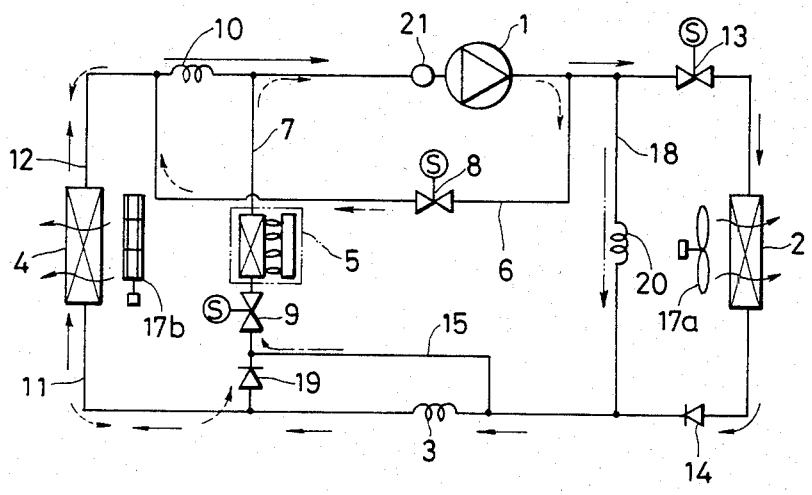
FIG. 3 is a refrigerant system diagram showing a third embodiment of the invention.

A third embodiment of the invention is shown in FIG. 3. First, the object of the third embodiments will be described. As is apparent from the first and second embodiments in FIGS. 1 and 2, the switching of the cooling and heating operations is achieved by operating the electromagnetic valves on the outlet side of the compressor. More specifically, one of the electromagnetic valves is used to control the conduction of refrigerant to the outdoor heat exchanger, and the other is used to control the conduction of refrigerant to the indoor heat exchanger or the refrigerant heater. By energizing one of the electromagnetic valves, either the cooling cycle circuit or the heating cycle circuit is completed, and the other is placed in a non-operational state. As a large amount of refrigerant flows in the electromagnetic valves, the latter have a large flow rate. Furthermore, normally closed electromagnetic valves (i.e. closed when not energized) are employed. Therefore, when the energization of an outdoor unit comprising the outdoor heat exchanger is suspended, both of the electromagnetic valves are closed. As a result, the refrigerant gas is locked under high pressure between the outlet of the compressor and these electromagnetic valves, and the pressure balance between the inlet and outlet sides of the compressor is impaired, which makes it difficult to again start the compressor.

In addition to the aforementioned objects of the invention, the third embodiment of the invention is intended to provide a cooling and heating device provided with a refrigerant circuit having a normally closed electromagnetic valve for controlling the flow of refrigerant at the output side of the compressor, in which the pressure imbalance between the inlet and outlet sides of the compressor is eliminated without adding further operating elements such as electromagnetic valves.

In this embodiment, the inlet side of the compressor 1 is connected through a balance circuit 18 to the outlet of the compressor. The balance circuit 18 is formed essentially of a balance capillary 20 which allows a slight flow of refrigerant gas. The balance circuit 18 is connected in parallel to the cooling series circuit of electromagnetic valve 13, outdoor heat exchanger 2 and check valve 14.

The electromagnetic valves 8 and 13 are used to control whether the refrigerant from the compressor 1 is delivered to the cooling cycle circuit or the heating cycle circuit, and are not closed unless the outdoor unit including the outdoor heat exchanger 2 is deenergized. However, when the outdoor unit is deenergized, both electromagnetic valves 8 and 13 are closed. In the pressure balance circuit 18, the balance capillary 20 exhibits high resistance. Therefore, in the ordinary circulation of refrigerant, refrigerant scarcely passes through the pressure balance circuit 18. However, when the electromagnetic valves 8 and 13 are closed as described above, the high pressure refrigerant gas on the discharge side of the compressor 1 can pass through the balance circuit 18. That is, the refrigerant gas locked under high pressure on the discharge side of the compressor 1 is re-Leased through the balance capillary 20 of the pressure balance circuit 18, so that the pressures on the suction and discharge sides of the compressor may be adjusted to permit the latter to be started again.

The locking of the refrigerant gas may of course be prevented by employing normally-open electromagnetic valves. However, as the valves must be large in flow rate, in the present circumstances it is difficult to employ normally-open electromagnetic valves.

Thus, the pressure balance circuit is considerably effective in practical use. The other circuit elements are similar to those in FIG. 2, and thus a description thereof will be omitted.

Figure 4:
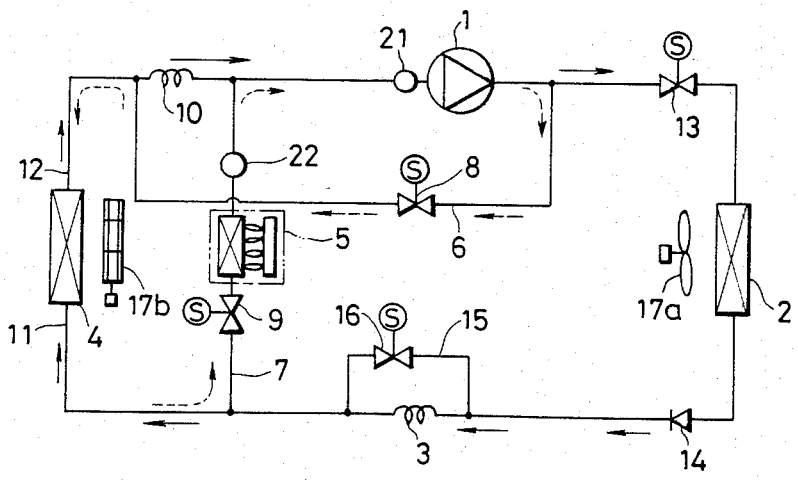
FIG. 4 is a refrigerant system diagram showing a fourth embodiment of the invention.

FIG. 4 shows a forth embodiment of the invention. The object of the fourth embodiment is not only to achieve the aforementioned objects of the invention but also to provide a liquid absorbing means near the suction inlet of the compressor and in the refrigerant heating circuit in order to positively prevent the suction of a mixture of refrigerant liquid and gas into the compressor during the heating operation.

As shown in FIG. 4, an accumulator 21 is provided near the suction inlet of the compressor 1 (as also shown in FIGS. 1 through 3) and an accumulator 22 is provided immediately downstream of a refrigerant heater 5 in a refrigerant heating circuit 7. The other circuit elements are similar in arrangement to those in FIG. 1.

If the accumulators 21 and 22 are not provided, the refrigerant is sometimes not completely gasified by the refrigerant heater 5 and accordingly refrigerant in both the gas and liquid phases may be sucked into the compressor, thus increasing the load of the latter. This difficulty can be eliminated by the absorbing action of the accumulators 21 and 22 provided downstream of the refrigerant heater 5 and at the suction side of the compressor 1.

An accumulator 21 is also provided on the suction side of the compressor 1 in each of the first, second and third embodiments. However, it should be noted that, when the refrigerant heater 5 is arranged as described above, without an additional accumulator the liquid absorbing function may be insufficient. Accordingly, by providing accumulators as shown in FIG. 4, the refrigerant passing to the compressor 1 can be limited to gaseous phase refrigerant, and an increase in the load on the compressor 1 can be positively prevented. Thus, the input to the compressor can be stabilized.

Figure 5:
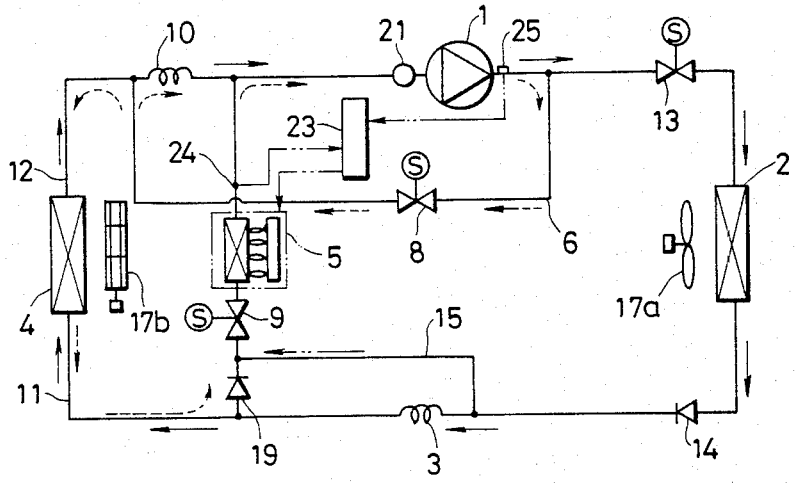
FIGS. 5 and 6 show a fifth embodiment of the invention. More specifically.
Figure 6:
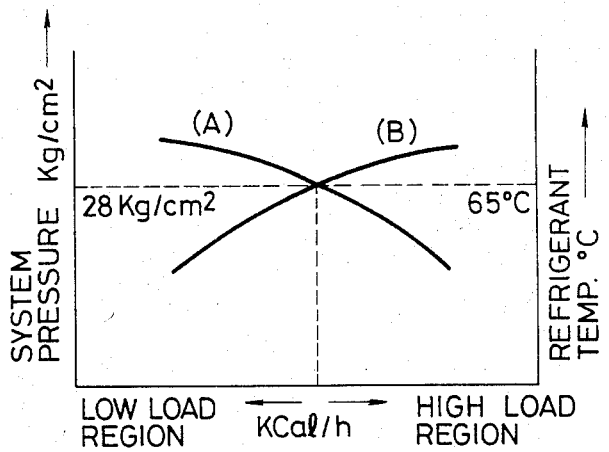

FIGS. 5 and 6 show a fifth embodiment of the invention. This embodiment is provided not only to achieve the above-described objects of the invention but also to provide a cooling and heating device of excellent protective capability in which the system pressure and the refrigerant temperature are maintained within allowable ranges thereof according to the relationships between the heating load, the system pressure and the refrigerant temperature.

In practice, it is essential to prevent the refrigerant from being overheated and protect lubricants from being deteriorated by heat, for protection of the cooling and heating device and for stable operation thereof over time.

The heating value of a refrigerant heater is typically controlled according to the refrigerant temperature at the outlet of the refrigerant heater or the difference between the refrigerant temperatures at the inlet and the outlet thereof. That is, in this control method, the heating value of the refrigerant heater is controlled so that the refrigerant temperature at the outlet, or the difference between the refrigerant temperatures at the inlet and the outlet, may not exceed predetermined values. Thus, this method has no capability of positively maintaining the pressure in the refrigerant circulation system, i.e., the heating cycle system within an allowable range. Since the pressure in the system tends to decrease in the heating operation under high load, the device may be protected by the above-described control method utilizing the refrigerant temperature. However, in a heating operation under low load, the pressure in the system tends to increase although the temperature at the outlet of the refrigerant heater is low, and accordingly it is difficult to positively protect the apparatus according to the above control method utilizing the refrigerant temperature.

In view of the foregoing, the cooling and heating device according to the fifth embodiment of the invention is designed so that, upon completion of the heating cycle circuit, the heating value of the refrigerant heater is controlled according to the output signal of a temperature detecting section provided at the outlet side of the refrigerant heater, with respect to the high load region, and is controlled according to the output signal of a pressure detecting section provided near the outlet of the compressor with respect to the low load region.

A temperature detector (such as a thermistor) 24 for detecting the temperature of the refrigerant on the outlet side of the refrigerant heater 5 and a pressure detector 25 for detecting the pressure of the refrigerant near the discharge outlet of the compressor 1 are provided, as shown in FIG. 5, and a control circuit 23 is provided which produces a control signal for controlling the heating value of the refrigerant heater 5 according to the output signals of the detectors 24 and 25. The other circuit elements are similar to those in FIG. 2, and therefore a detailed description thereof is omitted.

The relationship between the pressure in the system and the degree of heating load and the relationship between the temperature of the refrigerant and the degree of heating load are as indicated by characteristic curves (A) and (B) in FIG. 6, respectively. Curve (A) indicates the fact that the pressure in the system decreases as the heating load increases. Curve (B) indicates the fact that the refrigerant temperature is increased as the heating load increases. Based on the pressure, temperatures and load characteristic as described above, the refrigerant heater 5 is accurately controlled by the pressure detector 25, the temperature detector 24 and the control circuit 23.

In the lower load region in which the heating load is relatively low, the refrigerant temperature scarcely exceeds its allowance limit, but the pressure in the system may exceed the allowance limit. Therefore, a control signal is outputted by the control circuit 23 according to the output signal of the pressure detector 25 at the outlet of the compressure 1 and a reference input signal, to control the heating value of the refrigerant heater 5, to thereby control the pressure in the system to a desired value. On the other hand, in the high load region in which the heating load is relatively high, the pressure in the system scarcely exceeds the allowable limit, but the refrigerant temperature may exceed the allowable limit. Therefore, control according to pressure detection is switched over to control by which a control signal is provided according to the output signal of the temperature detector 24 and a reference input signal, to control the temperature of refrigerant. The low load region in which control is effected according to pressure detection, and the high load region in which control is effected according to the temperature detection can be distinguished from each other by referring to the load conditions at the intersection of the pressure curve (A) and the temperature curve (B) in FIG. 6. The pressure and the temperature at the intersection are generally about 28 $kg/cm^2.G$ and about 65° C., respectively. The control circuit 23 is thus designed so that it provides a signal for switching pressure control over to temperature control when the pressure in the system becomes lower than that mentioned above, and for switching temperature control over to pressure control when the detection temperature of the temperature detector 24 is lower than that mentioned above, whereby the device is automatically protected over the entire load region. That is, in the cooling and heating device according to the fifth embodiment of the invention, in the heating operation, both the pressure in the system and the temperature of the refrigerant in the circuit are monitored, whereby the system pressure and refrigerant temperature may be set to values suitable for the protection of the device.

In the above-described embodiments, the heat source of the refrigerant heater 5 is not particularly limited; that is, a variety of heat sources using gas or liquid fuels may be employed.

As is apparent from the above description, according to the invention, the condensation of dew in the refrigerant heater during the cooling operation can be eliminated, and degradation of the operational reliability due to an increase in the number of valves or the like can be prevented. As the same phase of refrigerant flows in each respective connecting pipe of the indoor heat exchange in both the cooling and heating operations, the connecting pipes can be respectively made of pipes for refrigerant liquid or gas only, which simplifies the piping and processing by as much.

What is claimed is:

1. A cooling and heating device, comprising:

(a) a cooling circuit including a series circuit of an outdoor heat exchanger, resistance means and an indoor heat exchanger;

(b) a compressor interposed between said indoor heat exchanger and said outdoor heat exchanger in said cooling circuit, for circulating refrigerant in said cooling circuit and in a heating circuit, said heating circuit comprising a cycle circuit branching from between a discharge outlet side of said compressor and said outdoor heat exchanger in said cooling circuit and returning to a suction inlet side of said compressor through said indoor heat exchanger;

(c) a refrigerant heater in said heating circuit bridging a connecting point between said indoor heat exchanger and said compressor and a connecting point between said resistance means and said indoor heat exchanger, refrigerant at high temperature heated by said refrigerant heater, during a heating operation, being circulated in a heating cycle circuit from said compressor, flowing in said indoor heat exchanger in a direction opposite that in which the refrigerant flows in said cooling circuit, radiating heat, entering said refrigerant heater where said refrigerant is again heated, and returning to said compressor; and first valve means, in said heating circuit, for preventing refrigerant from entering said refrigerant heater during a cooling operation.

2. A device as claimed in claim 1, further comprising second valve means for controlling refrigerant flowing in said cooling and said heating circuits.

3. A device as claimed in claim 2, in which said second valve means comprises a valve in each of said cooling and heating circuits.

4. A device as claimed in claim 2, in which said second valve means comprises at least one electromagnetic valve.

5. A device as claimed in claim 4, in which said second valve means comprises normally closed electromagnetic valves.

6. A device as claimed in claim 1, in which said resistance means is a capillary tube.

7. A device as claimed in claim 1, further comprising a purge circuit connected in parallel with said resistance means, refrigerant on the side of said outdoor heat exchanger being allowed to flow to said heating circuit through said purge circuit in switching a cooling operation over to a heating operation.

8. A device as claimed in claim 7, in which said purge circuit includes a valve for opening and closing said purge circuit.

9. A device as claimed in claim 8, in which said valve is an electromagnetic valve.

10. A device as claimed in claim 7, in which said purge circuit is connected between the connecting point between said outdoor heat exchanger and said resistance means in said cooling circuit and the connecting point between said refrigerant heater and said indoor heat exchanger in said heating circuit.

11. A device as claimed in claim 7, in which a valve is provided between the connecting point of said purge circuit and said heating circuit, and said indoor heat exchanger.

12. A device as claimed in claim 7, in which a valve is provided between the connecting point of said purge circuit and said heating circuit, and said indoor heat exchanger, said valve being a valve for allowing one-way flow of refrigerant to said refrigerant heater from said indoor heat exchanger.

13. A device as claimed in claim 1, in which a liquid absorbing member is provided on the suction inlet side of said compressor.

14. A device as claimed in claim 1, further comprising a balance circuit connected between the suction inlet side and discharge outlet side of said compressor.

15. A device as claimed in claim 14, in which a resistance element is inserted in said balance circuit.

16. A device as claimed in claim 14, in which said balance circuit is connected in parallel with said outdoor heat exchanger in said cooling circuit.

17. A device as claimed in claim 14, in which said balance circuit is connected in parallel with a series circuit of said outdoor heat exchanger and a valve for controlling the flow of refrigerant in said cooling circuit.

18. A device as claimed in claim 17, in which said valve for controlling the flow of refrigerant is an electromagnetic valve.

19. A device as claimed in claim 2, in which liquid absorbing members are provided near the suction inlet of said compressor and near the outlet of said refrigerant heater, respectively.

20. A device as claimed in claim 2, further comprising control means for controlling a heating value of said refrigerant heater in said heating cycle circuit according to the temperature of refrigerant at the outlet side of said refrigerant heater in the case of a high load, and according to the pressure at the discharge outlet side of said compressor in the case of low load.

21. A device as claimed in claim 1, wherein the phases of said refrigerant on either side of said indoor heat exchanger are maintained the same irrespective of whether said cooling and heating device operates in a cooling or heating mode.

22. A device as claimed in claim 1, further including a further connecting point between the outlet side of said compressor and said indoor heat exchanger, and a valve inbetween said outlet and said further connecting point.

23. A device as claimed in claim 22, further including further resistance means between said connecting point between said indoor heat exchanger and said compressor and said further connecting point between the outlet side of said compressor and said indoor heat exchanger.

* * * * *